US010145600B2

(12) United States Patent
Yun et al.

(10) Patent No.: US 10,145,600 B2
(45) Date of Patent: Dec. 4, 2018

(54) REFRIGERATOR

(71) Applicant: LG ELECTRONICS INC., Seoul (KR)

(72) Inventors: Seokjun Yun, Seoul (KR); Changho Seo, Seoul (KR); Sanggoo Park, Seoul (KR); Rajat Goyal, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/405,056

(22) Filed: Jan. 12, 2017

(65) Prior Publication Data

US 2017/0205131 A1 Jul. 20, 2017

(30) Foreign Application Priority Data

Jan. 14, 2016 (KR) ..... 10-2016-0004812

(51) Int. Cl.

| | |
|---|---|
| ***F25D 21/04*** | (2006.01) |
| ***F25D 11/02*** | (2006.01) |
| ***F25D 11/00*** | (2006.01) |
| ***F25D 29/00*** | (2006.01) |
| *F25D 23/06* | (2006.01) |

(52) U.S. Cl.

CPC ..... *F25D 11/025* (2013.01); *F25D 11/006* (2013.01); *F25D 29/006* (2013.01); *F25D 23/066* (2013.01); *F25D 2400/02* (2013.01)

(58) Field of Classification Search

CPC .... F25D 11/025; F25D 29/006; F25D 11/006; F25D 23/066; F25D 2400/02; F25D 21/04; F25B 25/00; F25B 1/00; F25B 21/00; F28D 15/02; F28D 15/043

See application file for complete search history.

(56) References Cited

U.S. PATENT DOCUMENTS

| | | | | |
|---|---|---|---|---|
| 2,511,419 | A * | 6/1950 | Smith | F25D 21/02 62/140 |
| 4,347,709 | A * | 9/1982 | Wu | F25D 21/02 340/580 |
| 9,897,365 | B2 * | 2/2018 | Lee | F25D 11/025 |
| 2003/0057546 | A1 * | 3/2003 | Memory | H05K 7/20681 257/706 |
| 2013/0019623 | A1 * | 1/2013 | Jo | F25D 11/025 62/190 |

(Continued)

FOREIGN PATENT DOCUMENTS

| | | | |
|---|---|---|---|
| JP | 6-78870 | B2 | 10/1994 |
| KR | 10-2012-0084857 | A | 7/2012 |

(Continued)

*Primary Examiner* — Emmanuel Duke

(74) *Attorney, Agent, or Firm* — Dentons US LLP

(57) ABSTRACT

A refrigerator includes a main body including a freezing-compartment inner case forming a freezing compartment and a refrigerating-compartment inner case forming a refrigerating compartment, and a heat transfer module including a thermosiphon part having a portion provided in the freezing-compartment inner case and another portion provided in the refrigerating-compartment inner case and having a closed loop in which working fluid for transferring heat flows and a heating member coupled to one side of the thermosiphon part to heat the working fluid. Other configurations are possible.

20 Claims, 6 Drawing Sheets

(56) References Cited

U.S. PATENT DOCUMENTS

| | | | | |
|---|---|---|---|---|
| 2013/0152621 | A1* | 6/2013 | Lee | F25D 11/025 62/441 |
| 2014/0298850 | A1* | 10/2014 | Lee | F25D 21/04 62/419 |

FOREIGN PATENT DOCUMENTS

| | | | |
|---|---|---|---|
| KR | 10-2013-0011277 | A | 1/2013 |
| KR | 10-2013-0011278 | A | 1/2013 |
| KR | 10-2013-0071577 | A | 7/2013 |
| KR | 10-2015-0138552 | A | 12/2015 |
| WO | 2007/083441 | A1 | 7/2007 |

* cited by examiner

REFRIGERATOR

CROSS-REFERENCE TO RELATED APPLICATION

This application claims priority under 35 U.S.C. §§ 119 and 365 to Korean Patent Application No. 10-2016-0004812, filed on Jan. 14, 2016 in the Korean Intellectual Property Office, the disclosure of which is incorporated herein by reference.

BACKGROUND

The present invention relates to a refrigerator.

In general, a refrigerator is a home appliance for storing food to be refrigerated or frozen and performs a cooling cycle to cool the inside of the refrigerator. The cooling cycle includes a compressor, a condenser, an expansion device, and an evaporator, which are connected through a refrigerant pipe to form a circulation loop. The compressor and the condenser are typically mounted in a mechanical compartment formed at the lower side of the refrigerator and the evaporator is typically provided at the rear side of a freezing compartment or a refrigerating compartment.

In such a refrigerator, during normal operation when power is supplied to the refrigerator to operate the compressor, the internal temperature of the refrigerator is kept constant because cool air generated in the evaporator continuously flows into the refrigerator through a fan. However, if a problem occurs during the cooling cycle due to failure of the compressor or power failure, the cooling cycle stops and the internal temperature of the refrigerator increases.

One method for solving the above problem is disclosed in Korean Unexamined Patent Publication No. 10-2013-0011277, which discloses a refrigerator including a thermosiphon part. However, the refrigerator disclosed in the above publication has the following problems. One, a separate part, such as a sensor, for identifying a normal state in which power is normally applied and a power failure state is necessary as well as a valve for controlling flow of fluid configuring thermosiphon and an accumulator. Since such a part and the valve are expensive, the price of the refrigerator may increase. Two, it requires a soldering process for connecting the valve for controlling thermosiphon and the accumulator. In this process, malfunction may occur due to soldering failure.

SUMMARY

An object of the present disclosure is to solve the above-described problems of the related art.

A refrigerator according to one embodiment of the present disclosure may include a main body including a freezing-compartment inner case forming a freezing compartment and a refrigerating-compartment inner case forming a refrigerating compartment, and a heat transfer module including a thermosiphon part having a portion provided in the freezing-compartment inner case and another portion provided in the refrigerating-compartment inner case and having a closed loop in which working fluid for transferring heat flows and a heating member coupled to one side of the thermosiphon part to heat the working fluid.

The thermosiphon part may include a condensation pipe for condensing the working fluid by cool air of the freezing compartment, an evaporation pipe for absorbing heat from cool air of the refrigerating compartment and evaporating the working fluid, a first connection pipe connecting an outlet of the evaporation pipe and an inlet of the condensation pipe such that the working fluid evaporated in the evaporation pipe flows into the condensation pipe, and a second connection pipe connecting an outlet of the condensation pipe and an inlet of the evaporation pipe such that the working fluid condensed in the condensation pipe flows into the evaporation pipe.

The heating member may include a coil heater provided to surround an outer circumferential surface of the second connection pipe.

The heating member may be coupled to the second connection pipe and is provided at a point close to a lower end of the second connection pipe.

The thermosiphon part may be disposed on an outer surface or inner surface of the main body.

The refrigerator may further include at least one of a heat transfer plate interposed between the condensation pipe and the freezing-compartment inner case and a heat transfer plate interposed between the evaporation pipe and the refrigerating-compartment inner case.

The thermosiphon part may further include at least one of a cold-storage material interposed between the condensation pipe and the freezing-compartment inner case and a cold-storage material interposed between the evaporation pipe and the refrigerating-compartment inner case.

The refrigerator may further include a first backdraft prevention pipe formed at an inlet side of the condensation pipe and rounded upwardly and a second backdraft prevention pipe formed at an inlet side of the evaporation pipe and rounded downwardly.

The condensation pipe may be provided on any one of the left and right side surfaces and rear surface of the freezing-compartment inner case, and the evaporation pipe may be provided on any one of the left and right side surfaces and rear surface of the refrigerating-compartment inner case.

One or both of the condensation pipe and the evaporation pipe may be bent several times to form a meander line.

The condensation pipe may be provided on any one of upper and lower surfaces of the freezing-compartment inner case, and the evaporation pipe may be provided on any one of upper and lower surfaces of the refrigerating-compartment inner case.

One or both of the condensation pipe and the evaporation pipe may be bent several times to form a meander line.

The evaporation pipe may be bent several times to form a meander line and may be provided to surround both side surfaces and a rear surface of the refrigerating-compartment inner case.

The evaporation pipe may extend in a horizontal direction along one side surface, a rear surface and the other side surface of the refrigerating-compartment inner case, bend in a vertical direction, and extend in the horizontal direction along the other side surface, the rear surface and one side surface of the refrigerating-compartment inner case, and the evaporation pipe may extend and bend several times.

The inlet of the evaporation pipe may be located at a lower end of the refrigerating-compartment inner case and the outlet of the evaporation pipe may be located at an upper end of the refrigerating-compartment inner case.

A refrigerator according to another embodiment of the present disclosure includes a refrigerating compartment and a freezing compartment, a cooling cycle connected to an evaporator of the freezing compartment, a thermosiphon cycle separated from the cooling cycle and connected to an evaporation pipe embedded in a wall of the refrigerating compartment and a condensation pipe provided adjacent to the evaporator of the freezing compartment, and a heater provided to surround a connection pipe between the evaporation pipe and the condensation pipe, for heating refrigerant. Power is supplied to the heater upon normal operation, and, upon power failure, power is not supplied to the heater to cool the refrigerating compartment by circulation of refrigerant in the thermosiphon cycle.

The thermosiphon cycle may include a condensation pipe for condensing the working fluid by cool air of the freezing compartment, an evaporation pipe for absorbing heat from cool air of the refrigerating compartment and evaporating the refrigerant, a first connection pipe connecting an outlet of the evaporation pipe and an inlet of the condensation pipe such that the refrigerant evaporated in the evaporation pipe flows in the condensation pipe, and a second connection pipe connecting an outlet of the condensation pipe and an inlet of the evaporation pipe such that the refrigerant condensed in the condensation pipe flows in the evaporation pipe.

The heater may include a coil heater provided to surround an outer circumferential surface of the second connection pipe.

The heater may be coupled to the second connection pipe and is provided at a point close to a lower end of the second connection pipe.

The refrigerator may further include a main body including a freezing-compartment inner case forming the freezing compartment and a refrigerating-compartment inner case forming the refrigerating compartment, and the thermosiphon cycle may be disposed on an outer surface or inner surface of the main body.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION

Advantages and features of the present disclosure and methods for achieving the merits and characteristics will be more clearly understood from embodiments described in detail later in conjunction with the accompanying drawings. However, the present disclosure is not limited to the disclosed embodiments, but may be implemented in various different ways. The embodiments are provided to only complete the disclosure of the present disclosure and to allow a person having ordinary skill in the art to which the present disclosure pertains to completely understand the category of the invention. The present disclosure is only defined by the category of the claims. The same reference numbers are used to refer to the same or similar elements throughout the specification.

Hereinafter, a refrigerator including a heat transfer module according to an embodiment of the present disclosure will be described in detail with reference to the drawings. Although a top mount type refrigerator in which a freezing compartment is provided on a refrigerating compartment is described herein, it is understood that the present invention is not limited thereto and is applicable to and a side-by-side type refrigerator in which a freezing compartment and a refrigerating compartment are provided side by side.

Figure 1:
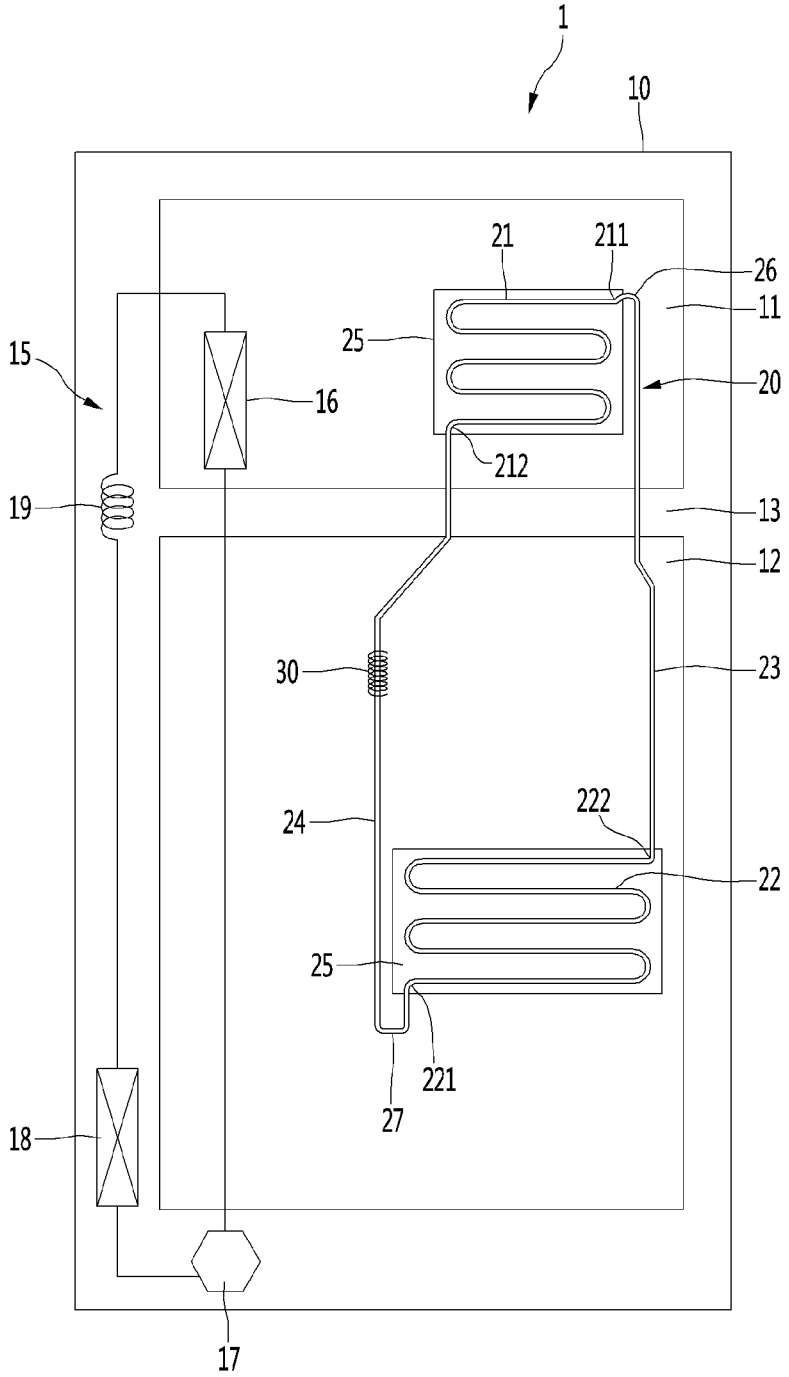
FIG. 1 is a diagram of a refrigerator including a heat transfer module according to a first embodiment of the present disclosure.

FIG. 1 is a conceptual diagram of a refrigerator including a heat transfer module according to a first embodiment of the present disclosure. Referring to FIG. 1, the refrigerator 1 may include a main body 10 having a storage space formed therein, a partition 13 for partitioning the storage space into a refrigerating compartment 12 and a freezing compartment 11, a cooling cycle 15 for cooling the refrigerating compartment 12 and the freezing compartment 11, and a heat transfer module 20 for transferring cool air from the freezing compartment to the refrigerating compartment using a thermosiphon phenomenon in the event of power failure. Cool air may be transferred from the freezing compartment to the refrigerating compartment through the heat transfer module 20, thereby minimizing increase in load of the refrigerating compartment.

More specifically, the cooling cycle 15 may include a compressor 17 for compressing low-temperature low-pressure refrigerant into high-temperature high-pressure supersaturated gaseous refrigerant, a condenser 18 disposed at the outlet side of the compressor 17 to condense high-temperature high pressure supersaturated gaseous refrigerant into high-temperature high-pressure saturated liquefied refrigerant, an expansion device 19 disposed at the outlet side of the condenser 18 to expand high-temperature high-pressure saturated liquefied refrigerant to low-temperature low-pressure 2-phase refrigerant, and an evaporator 16 disposed at the outlet side of the expansion device 19 into evaporate low-temperature low-pressure 2-phase refrigerant into low-temperature low-pressure gaseous refrigerant.

The compressor 17, the condenser 18, the expansion device 19, and the evaporator 16 are connected by a refrigerant flow channel (e.g., pipe) such that refrigerant is circulated along the refrigerant flow channel.

The evaporator 16 may be disposed at the rear side of the freezing compartment 11 so that cool air generated in the evaporator 16 is supplied to the freezing compartment 11 and the refrigerating compartment 12.

The cooling cycle is preferably continuously performed to maintain the refrigerating compartment and the freezing compartment at respective predetermined temperatures. Accordingly, power should be continuously supplied to the compressor. If power failure occurs, supply of power to the compressor is stopped and thus the cooling cycle is not performed. As a result, the temperatures of the refrigerating compartment and the freezing compartment will increase. In particular, because the temperature of the refrigerating compartment is higher than that of the freezing compartment, the temperature of the refrigerating compartment more rapidly increases.

If the cooling cycle 15 is not performed due to power failure, cool air of the freezing compartment 11 is transferred to the refrigerating compartment 12 using thermosiphon in order to minimize increase in load of the refrigerating compartment.

More specifically, the heat transfer module 20 may include a condensation pipe 21 disposed in a wall defining the freezing compartment 11 to liquefy working fluid flowing therein, an evaporation pipe 22 disposed in a wall defining the refrigerating compartment 12 to evaporate working fluid flowing therein, a first connection pipe 23 connecting an outlet 222 of the evaporation pipe and an inlet 211 of the condensation pipe such that working fluid evaporated in the evaporation pipe 22 flows in the condensation pipe 21, a second connection pipe 24 connecting an outlet 212 of the condensation pipe and an inlet 221 of the evaporation pipe such that working fluid liquefied in the condensation pipe 21 flows in the evaporation pipe 22, and a heating member 30 wound on the outer circumferential surface of the second connection pipe 24.

The condensation pipe 21, the evaporation pipe 22, the first connection pipe 23 and the second connection pipe 24 form a closed loop such that working fluid is circulated in the closed loop. The pipe part forming the closed loop may be referred to as a thermosiphon part. In other words, the heat transfer module 20 may include the thermosiphon part and the heating member 30 coupled to one side of the thermosiphon part. The thermosiphon part may include one pipe or a plurality of pipes. Here, the thermosiphon part may referred to as a thermosiphon cycle.

More specifically, as illustrated, the condensation pipe 21 may be located at the side of the freezing compartment 11 to condense gaseous working fluid into a liquid state. That is, the condensation pipe 21 may radiate heat absorbed by the working fluid to the freezing compartment 11.

The condensation pipe 21 may be bent several times in an up-and-down direction relative to the ground in order to increase a heat exchange area and a heat transfer plate 25 may be interposed between the wall of the freezing compartment 11 and the condensation pipe 21. The heat transfer plate 25 may be made of metal having high thermal conductivity.

Working fluid flows into the second connection pipe 24 by gravity after being converted from the gaseous state to the liquid state in the condensation pipe 21.

The inlet 211 of the condensation pipe 211 may be located above the outlet 212 of the condensation pipe. Since the condensation pipe 21 is bent several times in a vertical direction, working fluid flowing into the inlet 211 of the condensation pipe flows along the condensation pipe 21 and moves to the outlet 212 of the condensation pipe 21.

A first backdraft prevention pipe 26 for preventing liquid working fluid flowing in the condensation pipe 21 from flowing back into the first connection pipe 23 may be further formed in the inlet 211 of the condensation pipe. More specifically, for example, the first backdraft prevention pipe 26 may be a part or a portion of the condensation pipe 21 that is rounded upwardly and protrudes above the uppermost horizontal portion of the condensation pipe 21. Accordingly, working fluid condensed into the liquid state in the condensation pipe 21 is prevented from flowing back to the first connection pipe 23 using the first backdraft prevention pipe 26.

The condensation pipe 21 may be disposed at the left surface or right surface defining the freezing compartment 11 and may be disposed at the inner surface or outer surface of the freezing compartment 11.

The evaporation pipe 22 may be disposed at the side of the refrigerating compartment 12 so that liquid working fluid is converted into a gaseous state by absorbing heat from cool air.

Similarly to the condensation pipe 21, the evaporation pipe 22 may be bent several times in order to increase a heat exchange area. In addition, to increase a heat exchange area and heat exchange capacity, the heat transfer plate 25 may be interposed between the evaporation pipe 22 and the wall of the refrigerating compartment 11. That is, the evaporation pipe 22 may be adhered or fixed to a first surface of the heat transfer plate 25 and the wall of the refrigerating compartment 11 may be adhered or fixed to a second surface of the heat transfer plate 25. The first and second surfaces may be opposite surfaces.

Working fluid evaporated by absorbing heat from cool air of the refrigerating compartment rises due to low specific gravity thereof and thus moves to the first connection pipe 23 through the evaporation pipe 22. As shown in FIG. 1, the inlet 221 of the evaporation pipe 222 is preferably located lower than the outlet 222 of the evaporation pipe 222.

A second backdraft prevention pipe 27 may be formed in the inlet 221 of the evaporation pipe to prevent working fluid evaporated in the evaporation pipe 22 from flowing back to the second connection pipe 24. That is, as shown in FIG. 1, the second backdraft prevention pipe 27 may be a part in which a portion of the condensation pipe 21 is rounded downwardly and located below the lowermost horizontal portion of the evaporation pipe 22, thereby preventing gaseous working fluid from flowing toward the second connection pipe 24.

Since liquid working fluid falling from the condensation pipe 21 is collected in the bottom portion of the second backdraft prevention pipe 27, working fluid evaporated in the evaporation pipe 22 is prevented from thrusting and moving liquid working fluid toward the second connection pipe 24.

Upon power failure, the second connection pipe 24 is a flow channel in which working fluid liquefied in the condensation pipe 21 flows and the first connection pipe 23 refers to a flow channel in which working fluid evaporated in the evaporation pipe 22 flows.

Working fluid evaporates while flowing along the evaporation pipe 22, rises along the first connection pipe 23, flows into the condensation pipe 21 to be condensed to a liquid state, falls along the second connection pipe 23, and flows into the evaporation pipe 22 again. Such working fluid is circulated when operation of the cooling cycle 15 is stopped, thereby preventing load of the refrigerating compartment 12 from being delivered to the freezing compartment 12 to rapidly increase the temperature of the refrigerating compartment.

When power is normally supplied to normally perform the cooling cycle 15, the heating member 30 operates to prevent circulation of working fluid. That is, the heating member 30 evaporates working fluid falling along the second connection pipe 24 such that gaseous working fluid prevents liquid working fluid from falling.

The heating member 30 of the present invention may be located at the middle of the circulation structure of the heat transfer module 20. More specifically, the heating member 30 may be located at any point on the second connection pipe 24 where liquid working fluid discharged from the condensation pipe 21 flows downwardly due to gravity. For example, the heating member 30 may be provided closer to the evaporation pipe 22 than the condensation pipe 21. Preferably, the heating member 30 is provided adjacent to the second backdraft prevention pipe 27 to evaporate liquid working fluid collected in the lower end of the second connection pipe 24. If the heating member 30 is provided at the middle part of the second connection pipe 24, since heat is supplied to falling liquid working fluid, working fluid may not be sufficiently evaporated.

As another example, the heating member 30 may be provided at a point of the second connection pipe 24 which is separated from the side wall or rear wall of the refrigerating compartment 12. When the heating member 30 operates, the temperature of a portion of the refrigerating compartment 12 adjacent to the heating member 30 may increase. When the heating member 30 is provided to contact the side wall or rear wall of the refrigerating compartment 12, the heating member 30 supplies heat to the refrigerating compartment 12 to increase the load of the refrigerating compartment 12. Accordingly, the heating member 30 may be provided at a point separated from any one of the side wall and rear wall of the refrigerating compartment 12.

Working fluid evaporated by the heating member 30 rises along the second connection pipe 24 to generate pressure resistance pushing up liquid working fluid falling from the condensation pipe 21. Liquid working fluid does not fall due to such pressure resistance such that working fluid is not circulated. Therefore, cool air of the refrigerating compartment and cool air of the freezing compartment do not exchange heat with each other.

The heating member 30 may be a coil heater that surrounds the outer circumferential surface of the second connection pipe 24.

Hereinafter, an embodiment in which a cold-storage material 40 is provided in the freezing compartment 11 to perform cold reserving operation of the freezing compartment 11 and increase a time for maintaining the temperature of the refrigerating compartment 12 upon power failure will be described in detail with reference to the drawings.

The below-described heat transfer module has the same structure as the heat transfer module of FIG. 1 and thus a detailed description of the same components will be omitted.

Figure 2:
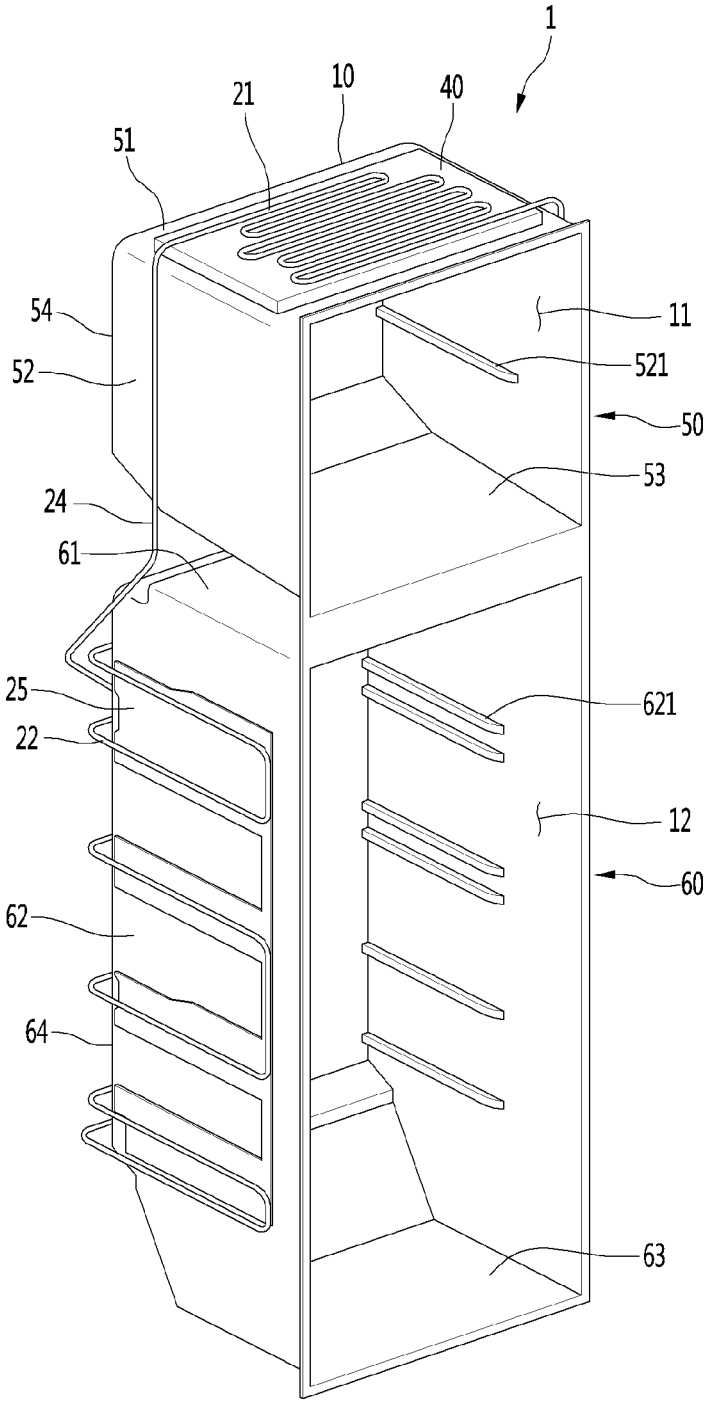
FIG. 2 is a perspective view of a refrigerator using a heat transfer module according to a second embodiment of the present disclosure.
Figure 3:
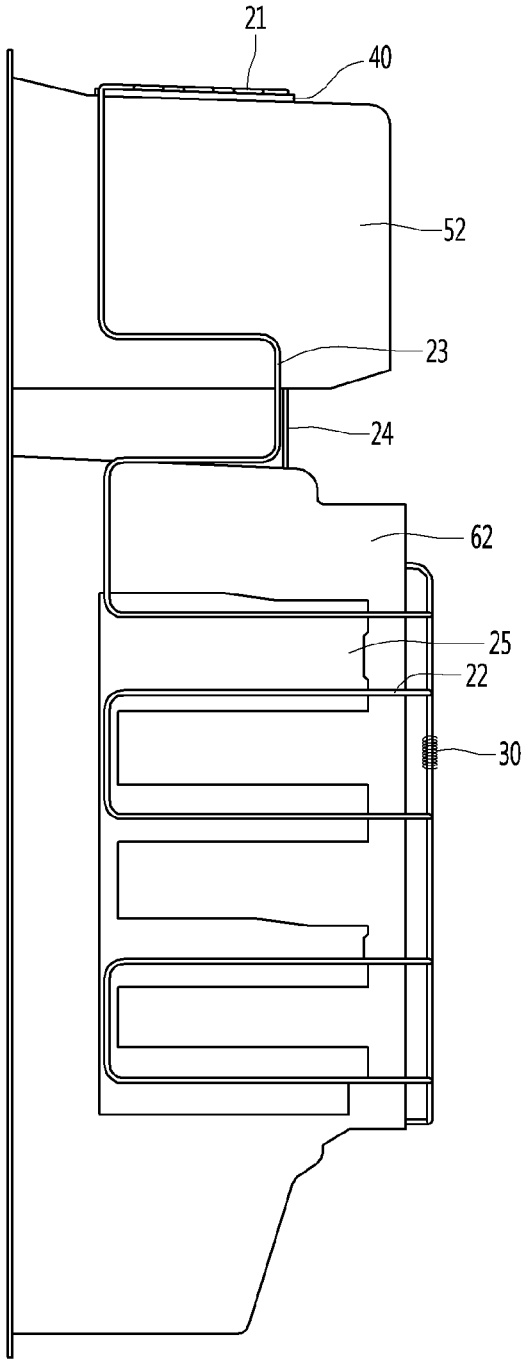
FIG. 3 is a right side view of the refrigerator of FIG. 2.
Figure 4:
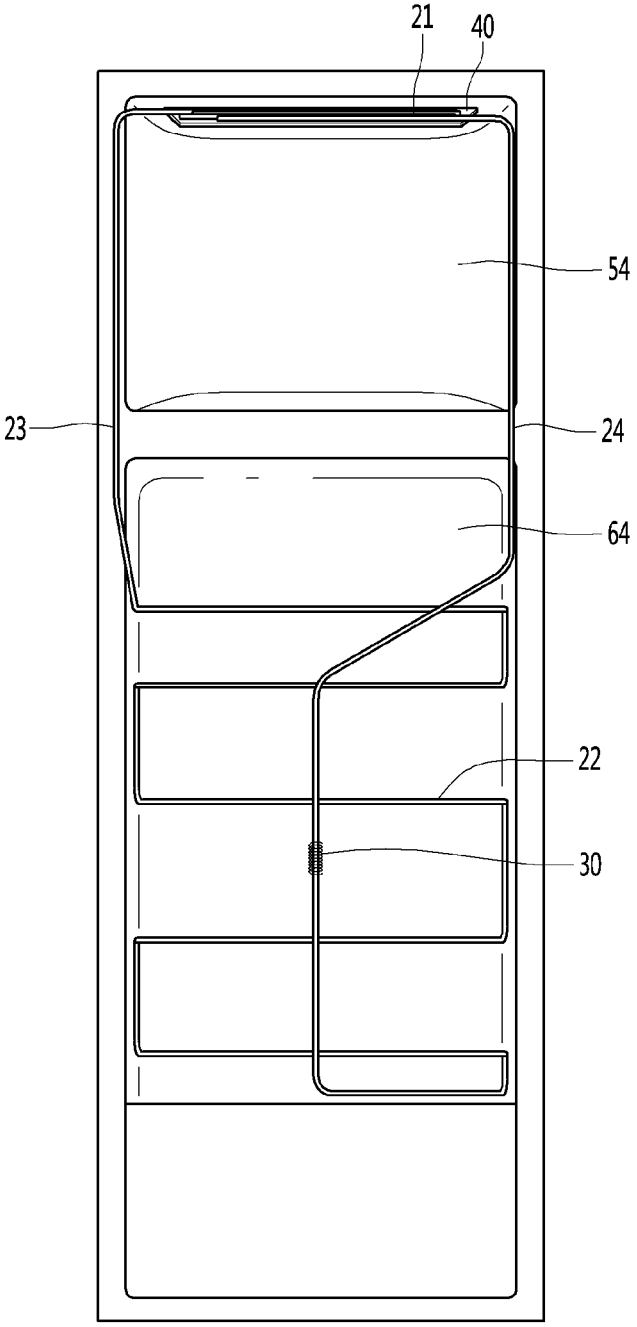
FIG. 4 is a rear view of the refrigerator of FIG. 2.
Figure 5:
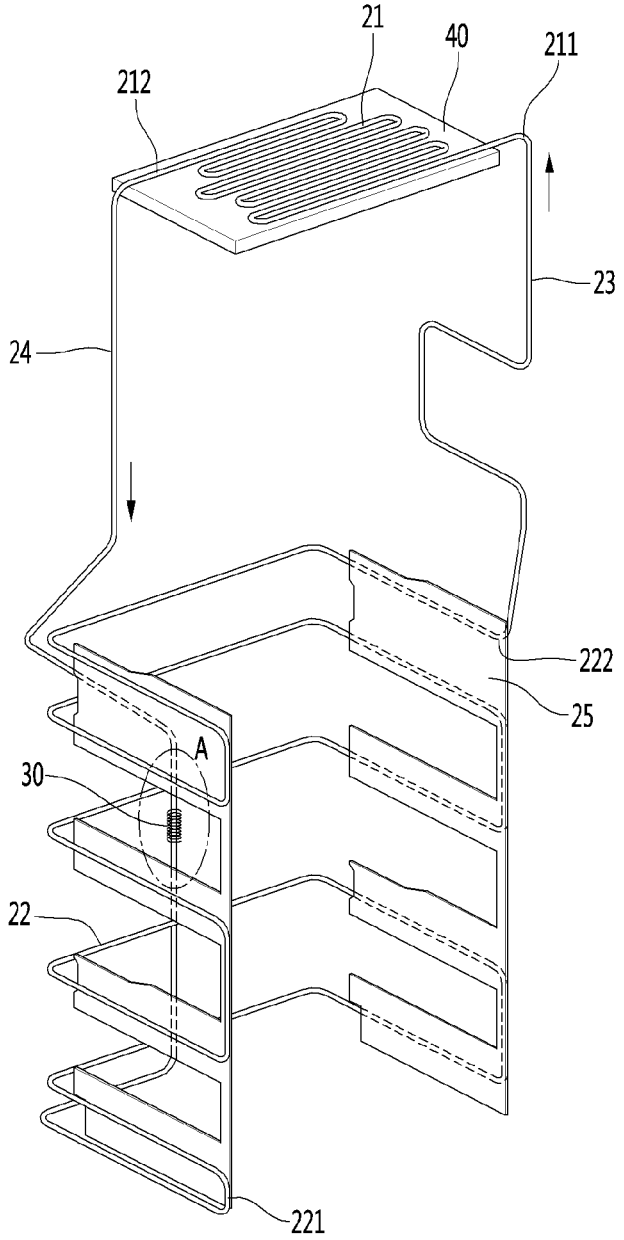
FIG. 5 is a perspective view of the heat transfer module of FIG. 2.
Figure 6:
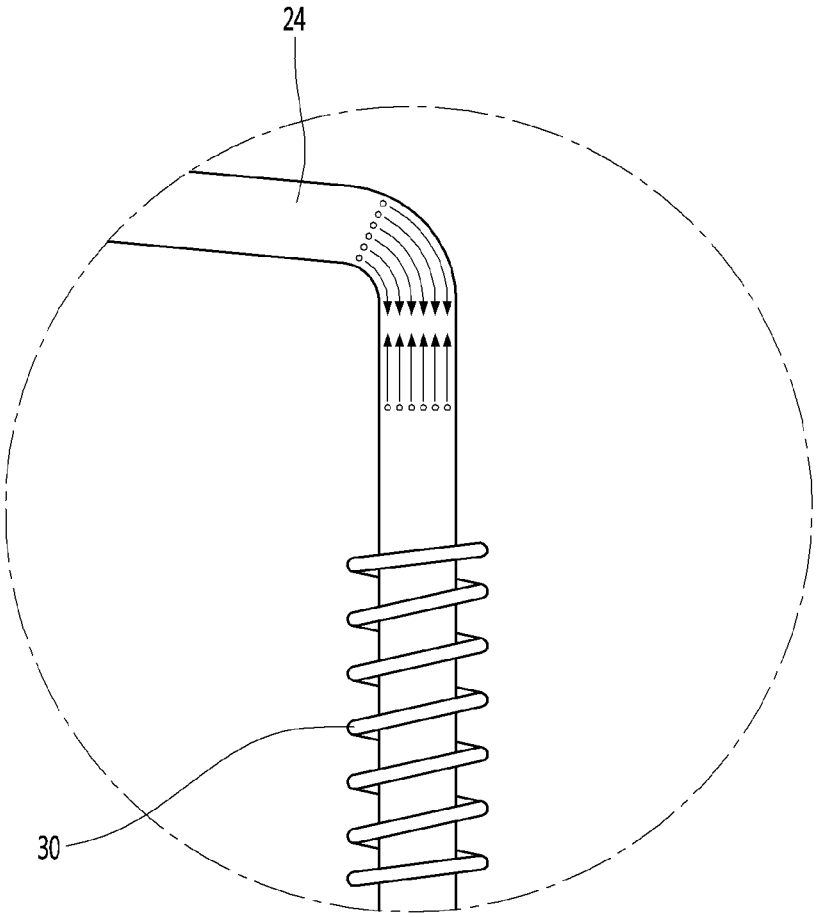
FIG. 6 is an enlarged view of a portion A of FIG. 5.

FIG. 2 is a perspective view of a refrigerator using a heat transfer module according to a second embodiment of the present disclosure. FIG. 3 is a right side view of the refrigerator of FIG. 2. FIG. 4 is a rear view of the refrigerator of FIG. 2. FIG. 5 is a perspective view of the heat transfer module of FIG. 2. FIG. 6 is an enlarged view of portion A of FIG. 5.

Referring to FIGS. 2 through 6, the heat transfer module 20 according to the second embodiment is different from the heat transfer module of the first embodiment in that the condensation pipe 21 is disposed on an upper surface of the freezing compartment 21 and is repeatedly bent in the horizontal direction. The condensation pipe 21 may be attached to the inner surface or outer surface of the freezing compartment 11.

In addition, the second embodiment is different from the first embodiment in that a cold-storage material 40 having a plate shape is interposed between the condensation pipe 21 and the wall of the freezing compartment 11. The cold-storage material 40 is provided to store cool air of the freezing compartment while the refrigerator 1 normally operates and to provide cool air to the freezing compartment 11 upon power failure. The cold-storage material 40 also condenses gaseous working fluid flowing into the condensation pipe 21 upon power failure.

The cold-storage material 40 may be provided instead of the heat transfer plate 25 of the first embodiment or the heat transfer plate 25 may be provided instead of the cold-storage material 40.

The cold-storage material having a plate shape may be interposed between the evaporation pipe 22 and the wall of the refrigerating compartment 12.

The main body 10 may include a freezing-compartment inner case 50 forming the freezing compartment 11 and a refrigerating-compartment inner case 60 provided under the freezing-compartment inner case 11 and forming the refrigerating compartment 12.

More specifically, the freezing-compartment inner case 50 may have an openable front surface and have a hexahedral box shape to form the freezing compartment 11. The freezing-compartment inner case 50 may include an upper surface 51, a pair of side surfaces 52 extending downward from the left and right ends of the upper surface 51, a rear surface 54 extending downward from the rear end of the upper surface 51, and a lower surface 53 connecting the pair of side surfaces 52 and the rear surface 54.

First protrusions 521 supporting a shelf may be formed at the inner surfaces of the pair of side surfaces 52. The first protrusions 521 may extend in the front-and-rear direction of the refrigerator 1 and a plurality of first protrusions may be provided to be separated from each other in an up-and-down direction.

In addition, the refrigerating-compartment inner case 60 may have the same hexahedral box shape as the freezing-compartment inner case 50 except that the height thereof is different from that of the freezing-compartment inner case 50. That is, the refrigerating-compartment inner case 60 may include an upper surface 61, a pair of side surfaces 62 extending downward from the left and right ends of the upper surface 61, a rear surface 64 extending downward from the rear end of the upper surface 61, and a lower surface 63 connecting the pair of side surfaces 62 and the rear surface 64.

Second protrusions 621 supporting shelves may be formed at the inner surfaces of the pair of side surfaces 62. The structures of the refrigerating-compartment inner case 60 and the freezing-compartment inner case 50 are equally applicable to the refrigerator 1 according to the first embodiment.

The thermosiphon part of the heat transfer module 20 according to another embodiment of the present invention includes the condensation pipe 21, the evaporation pipe 22, the first connection pipe 23 connecting the inlet 211 of the condensation pipe and the outlet 222 of the evaporation pipe 22, and the second connection pipe 24 connecting the outlet 212 of the condensation pipe and the inlet 221 of the evaporation pipe 22.

The first backdraft prevention pipe of the first embodiment may be formed in the inlet 211 of the condensation pipe 21 and the second backdraft prevention pipe of the first embodiment may be formed in the inlet 221 of the evaporation pipe 22.

The heating member 30 may be provided at any point of the second connection pipe 24. More particularly, the heating member 30 may be formed at a point that is close to the lower end of the second connection pipe 24.

The evaporation pipe 22 may have a structure different from that of the evaporation pipe of the first embodiment.

More specifically, the second connection pipe 24 may extend to the lower end of the refrigerating-compartment inner case 60, and bend and extend at the lower end of the refrigerating-compartment inner case 60 to surround one side surface, the rear side, and the other side surface of the refrigerating-compartment inner case 60. The second connection pipe 24 may bend upwardly at the front end of the other side surface of the refrigerating-compartment inner case 60 and then bend to the rear side, thereby surrounding the other side surface, the rear surface, and one side surface of the refrigerating-compartment inner case 60. The second connection pipe 24 may zigzag several times from one side surface to the other side surface of the refrigerating-compartment inner case 60 and extend from the lower end to the upper end of the refrigerating-compartment inner case 60. The first connection pipe 23 may extend from the upper end of the side surface of the refrigerating-compartment inner case 60 to the inlet 211 of the condensation pipe.

The second connection pipe 24 may extend downward along the side surface of the refrigerating-compartment inner case 60 and then extend downward along the center of the rear surface of the refrigerating-compartment inner case 60.

Similar to the first embodiment, the heat transfer plate 25 may be attached between the evaporation pipe 22 and the refrigerating-compartment inner case 60. The second protrusions 621 formed on the inner surfaces of the refrigerating-compartment inner case 60 may be formed at points between the heat transfer plates adjacent in the up-and-down direction.

Hereinafter, operation of the heat transfer module 20 of the refrigerator 1 upon power failure will be described in detail.

First, when the refrigerator normally operates, the heating member 30 operates to evaporate liquid working fluid passing through the second connection pipe 24. Liquid working fluid is converted into a gaseous state due to evaporation and gaseous working fluid rises while pressurizing liquefied working flow falling from the condensation pipe 21. Accordingly, circulation of working fluid in the heat transfer module 20 stops because liquid working fluid no longer falls.

Upon power failure, because power is not being supplied to the heating member 30, operation of the heating member 30 is stopped. Liquid working fluid falling from the condensation pipe 21 passes through the evaporation pipe 22 to be circulated in the heat transfer module 20. In such a circulation process, working fluid supplies cool air sucked from the freezing compartment 11 through the condensation pipe 21 to the refrigerating compartment 1, thereby minimizing increase in load of the refrigerating compartment.

To conserve energy, the heating member 30 may operate for a predetermined operation period. For example, the heating member 30 may be set to operate at a predetermined timing or a predetermined time interval according to a user pattern.

When the heating member 30 does not operate in a normal operation state, since working fluid is circulated in the heat transfer module 20, the cold-storage material 40 located in the freezing compartment 11 may not freeze. The freezing point of the cold-storage material 40 provided in the freezing compartment 11 may be higher than the freezing point of a conventional cold-storage material of about −7° C. by about −1.5° C.

According to the present invention having the above-described configurations, a separate part for identifying a normal state in which power is normally applied and a power failure state, such as a sensor, is not required and a valve for controlling flow of fluid in the thermosiphon part and an accumulator are not required, thereby reducing the price of a product.

In addition, since a soldering process of connecting the valve for controlling flow of fluid in the thermosiphon part and the accumulator is omitted, a manufacturing process can be simplified and failure can be prevented from occurring in the soldering process.

Since the heating member operates in a normal state to suppress circulation of working fluid of thermosiphon and power is not supplied to the heating member to circulate working fluid upon power failure, cool air of the refrigerating compartment and cool air of the freezing compartment exchange heat with each other through working fluid of thermosiphon. Accordingly, it is possible to prevent the temperature of the refrigerating compartment from rapidly increasing even upon power failure.

In addition, since power is not supplied to the heating member upon power failure, a separate control device for controlling stoppage of operation of the heating member is not necessary.

It is understood that variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a main body comprising a freezer compartment and a refrigeration compartment;

a cooling cycle connected to an evaporator of the freezer compartment; and a heat transfer module comprising a thermosiphon part having a first portion disposed in the freezer compartment and a second portion disposed in the refrigeration compartment, and a heating member attached to a side of the thermosiphon part and configured to heat the working fluid;

wherein the heat transfer module comprises a closed loop configured to let working fluid for transferring heat flow in the closed loop by the heating member, wherein the heating member is configured to operate to prevent circulation of working fluid when power is normally supplied to normally perform the cooling cycle.

2. The refrigerator according to claim 1, wherein the thermosiphon part includes:

a condensation pipe to condense the working fluid by cool air of the freezer compartment;

an evaporation pipe to absorb heat from the cool air of the refrigeration compartment and evaporate the heat transfer fluid;

a first connection pipe connecting an outlet of the evaporation pipe and an inlet of the condensation pipe so that the working fluid evaporated in the evaporation pipe flows into the condensation pipe; and a second connection pipe connecting an outlet of the condensation pipe and an inlet of the evaporation pipe so that the working fluid condensed in the condensation pipe flows into the evaporation pipe.

3. The refrigerator according to claim 2, wherein the heating member includes a coil heater that at least partially surrounds an outer circumferential surface of the second connection pipe.

4. The refrigerator according to claim 2, wherein the heating member is coupled to the second connection pipe and is disposed proximate to a lower end of the second connection pipe.

5. The refrigerator according to claim 2, wherein the thermosiphon part is disposed at an outer surface or an inner surface of the main body.

6. The refrigerator according to claim 2, further comprising at least one of:

a heat transfer plate provided between the condensation pipe and the freezer compartment; and a heat transfer plate provided between the evaporation pipe and the refrigeration compartment.

7. The refrigerator according to claim 2, further comprising at least one of:

a cold-storage material provided between the condensation pipe and the freezer compartment; and a cold-storage material provided between the evaporation pipe and the refrigeration compartment.

8. The refrigerator according to claim 2, further comprising:

a first backdraft prevention pipe provided at an inlet side of the condensation pipe and rounded in an upward direction relative to the ground; and a second backdraft prevention pipe provided at an inlet side of the evaporation pipe and rounded in a downward direction.

9. The refrigerator according to claim 2, wherein the condensation pipe is provided on any one of a left side surface, a right side surface, or a rear surface of the freezer compartment, and wherein the evaporation pipe is provided on any one of a left side surface, a right side surface, or a rear surface of the refrigeration compartment.

10. The refrigerator according to claim 2, wherein at least one of the condensation pipe and the evaporation pipe is formed having a plurality of bends.

11. The refrigerator according to claim 2, wherein the condensation pipe is provided on an upper surface or a lower surface of the freezer compartment, and wherein the evaporation pipe is provided on an upper surface or a lower surface of the refrigeration compartment.

12. The refrigerator according to claim 11, wherein at least one of the condensation pipe and the evaporation pipe is formed having a plurality of bends.

13. The refrigerator according to claim 11, wherein the evaporation pipe is formed having a plurality of bends and is provided to at least partially surround a left side surface, a right side surface, and a rear surface of the refrigeration compartment.

14. The refrigerator according to claim 13, wherein the evaporation pipe extends in a horizontal direction along one of the left and right side surfaces, a rear surface, and the other of the left and right side surfaces of the refrigeration compartment, then bends in a vertical direction, and then extends in the horizontal direction along the other of the left and right side surfaces, the rear surface, and the one of the left and right side surfaces of the refrigeration compartment.

15. The refrigerator according to claim 13, wherein the inlet of the evaporation pipe is located at a lower end of the refrigeration compartment and the outlet of the evaporation pipe is located at an upper end of the refrigeration compartment.

16. A refrigerator comprising:

a refrigeration compartment;

a freezer compartment;

a cooling cycle connected to an evaporator of the freezer compartment;

a thermosiphon cycle separated from the cooling cycle and connected to an evaporation pipe of the refrigeration compartment and a condensation pipe provided adjacent to the evaporator of the freezer compartment; and a heater for heating a refrigerant, the heater being disposed between the evaporation pipe and the condensation pipe, and being arranged to at least partially surround a connection pipe, wherein power is supplied to the heater upon normal operation of the refrigerator, and wherein, upon a power failure, power is not supplied to the heater so that the refrigeration compartment is cooled by circulation of the refrigerant in the thermosiphon cycle, wherein the heater is configured to operate to prevent circulation of working fluid when power is normally supplied to normally perform the cooling cycle.

17. The refrigerator according to claim 16, wherein the thermosiphon cycle includes:

a condensation pipe that condenses the refrigerant via cool air of the freezer compartment;

an evaporation pipe that absorbs heat from cool air of the refrigeration compartment and evaporates the refrigerant;

a first connection pipe connecting an outlet of the evaporation pipe and an inlet of the condensation pipe so that the refrigerant evaporated in the evaporation pipe flows in the condensation pipe; and a second connection pipe connecting an outlet of the condensation pipe and an inlet of the evaporation pipe so that the refrigerant condensed in the condensation pipe flows in the evaporation pipe.

18. The refrigerator according to claim 17, wherein the heater includes a coil heater provided to at least partially surround an outer circumferential surface of the second connection pipe.

19. The refrigerator according to claim 17, wherein the heater is coupled to the second connection pipe and is disposed proximate to a lower end of the second connection pipe.

20. The refrigerator according to claim 16, further comprising:

a main body comprising a freezing-compartment inner case forming the freezer compartment and a refrigerating-compartment inner case forming the refrigeration compartment, wherein the thermosiphon cycle is disposed on an outer surface or an inner surface of the main body.

* * * * *